United States Patent [19]

Lundqvist

[11] Patent Number: 5,022,499

[45] Date of Patent: Jun. 11, 1991

[54] AXIALLY SLIT PRESSURE CYLINDER WITH BRAKE MEANS

[75] Inventor: Gunnar Lundqvist, Millingsnäsgard, Sweden

[73] Assignee: Hygrama Ag, Switzerland

[21] Appl. No.: 486,126

[22] Filed: Feb. 28, 1990

[30] Foreign Application Priority Data

Feb. 28, 1989 [DE] Fed. Rep. of Germany ..... 3906211

[51] Int. Cl.[5] ..... B65H 59/10

[52] U.S. Cl. ..... 188/67; 188/250 R; 92/88; 92/14; 92/28

[58] Field of Search ..... 92/88, 15, 18, 20, 21 R, 92/24, 27, 28, 143, 14; 188/67, 43

[56] References Cited

U.S. PATENT DOCUMENTS

| | | | |
|---|---|---|---|
| 3,221,610 | 12/1965 | King et al. | 92/88 |
| 3,871,267 | 3/1975 | Miller | 92/88 |
| 3,893,378 | 7/1975 | Hewitt | 92/88 |
| 4,137,827 | 2/1979 | Hewitt | 92/88 |
| 4,234,060 | 11/1980 | Barsted | 188/44 |
| 4,419,924 | 12/1983 | Peter et al. | 92/88 |
| 4,664,019 | 5/1987 | Lipinski et al. | 92/88 |
| 4,785,716 | 11/1988 | Vaughn et al. | 92/88 |
| 4,825,746 | 5/1989 | Herner | 92/88 |
| 4,856,415 | 8/1989 | Noda | 92/88 |
| 4,926,982 | 5/1990 | Granbom | 188/67 |

FOREIGN PATENT DOCUMENTS

| | | |
|---|---|---|
| 190760 | 2/1986 | European Pat. Off. . |
| 280309 | 8/1988 | European Pat. Off. . |
| 2453948 | 5/1975 | Fed. Rep. of Germany . |
| 2945133 | 6/1981 | Fed. Rep. of Germany . |
| 7931576 | 6/1981 | Fed. Rep. of Germany . |
| 3328292 | 2/1985 | Fed. Rep. of Germany . |
| 8511577 | 7/1985 | Fed. Rep. of Germany . |
| 3504269 | 8/1986 | Fed. Rep. of Germany . |
| 1318619 | 5/1973 | United Kingdom . |

*Primary Examiner*—John T. Kwon
*Assistant Examiner*—Thomas Denion
*Attorney, Agent, or Firm*—Eckert Seamans Cherin & Mellott

[57] ABSTRACT

A piston rod-free pressure cylinder, in which a force reducer (15) is connected by means of a lateral projection (14) to the working piston (13), has a brake mechanism (19), which acts with a brake lining (27) on the outside of the pressure cylinder (11). Action takes place in such a way that no transverse forces are exerted on the projection (14).

11 Claims, 4 Drawing Sheets

AXIALLY SLIT PRESSURE CYLINDER WITH BRAKE MEANS

BACKGROUND OF THE INVENTION

1. Field of the Invention

The invention relates to a pressure or pressure medium cylinder with a terminally closed, tubular casing having a sealed elongated slot and in whose cylindrical interior is guided in longitudinally displaceable manner a sealed piston, which has a lateral force reducing projection extending through the elongated slot. Pressure cylinders of this type, which are also known as piston rod-free pressure cylinders, have the advantage of limited space requirements.

2. Prior Art

A pressure cylinder of this type is already known (EP-Al-190 760), which has a locking brake, The latter contains two brake elements, which act on the casing in the vicinity of the elongated slot, namely in the axial ends of the working piston. In this way the length of the force reducing projection is greater than the length of the working piston, so that there is an overall reduction in the movement range of the pressure cylinder.

A further working cylinder of this type is known (DE-Al-33 28 292), in which a brake profile is arranged laterally alongside the cylinder casing and is fixed at both ends to the two cylinder heads. The braking mechanism is connected by means of a U-shaped member to the force reducer. Apart from the additional lateral space requirement, this results in that forces occurring on braking are asymmetrically transferred to the force reducer and therefore to the piston.

In the case of piston rod-free working cylinders not having an elongated slot, but which operate with the aid of a seal strip which longitudinally traverses the cylinder, it is known (DE-Ul-79 31 576), to displace a slide on the outside of the cylinder casing and which operates in the opposite direction to the working piston. This slide can concentrically embrace the cylinder tube with a brake lining and press the same inwards. However, this construction suffers from the disadvantage that the outside of the casing is no longer available for other components, e.g. positioning switches, scales provided with locking means, etc.

It is also known in connection with piston rod-free working cylinders (DE-OS No. 24 53 948) to provide brake wedges or chocks in the cylinder working bore, which press outwards and therefore lock the working cylinder against the wall. However, this is not a particularly suitable solution, because the piston should slide in the cylinder bores and consequently the latter is lubricated.

SUMMARY OF THE INVENTION

An object of the invention is to provide a pressure cylinder of the aforementioned type, which permits precise braking in the case of simple construction. Moreover, existing constructions are to be retained in substantially unchanged form.

According to the invention this object is achieved in that to the force reducer of a pressure cylinder is fixed a braking mechanism, which has a brake element movable in the direction of the surface of the working cylinder and acting with a braking surface on the working cylinder surface.

The invention creates the possibility as to how, without constructional changes to the pressure cylinder, the latter can be provided with a simply and reliably acting brake. There is no need for a brake profile to be additionally fixed, because the brake acts on the actual casing.

According to a further development of the invention the brake mechanism has a brake piston movable through fluid pressure. It can be operable by hydraulic fluid or also air pressure. Preferably use is made of the same fluid as is used for driving the working piston.

According to a further development of the invention the brake piston is movable approximately radially to the pressure cylinder. This makes it possible to avoid trouble-prone intermediate elements or those reducing the braking force.

The invention also proposes that the brake piston is provided on its side facing the cylinder with a brake lining forming the braking surface, which can e.g. be bonded on. This makes it possible to give a very simple construction to the brake mechanism, because it only has a brake piston movable in a recess and a brake lining. It is obviously possible to provide auxiliary means, e.g. a spring, which urges the brake piston into a normal position freeing the brake.

According to a further development the braking surface is adapted to the cross-sectional shape of the cylinder or corresponds thereto. The brake mechanism proposed by the invention can be used for the most varied cylinder shapes, namely both for cross-sectionally linear portions and for the cross-sectionally curved portions.

In order to achieve a good braking force, the braking area can be made as large as possible. However, so as not to increase the space requirement for the system compared with one without a brake, the invention proposes that the side of the brake piston facing the cylinder surface extends roughly over the entire axial length of the working piston. As the extent of the displacement of the working piston is determined by the cylinder length, reduced by the actual working piston length, in this way a large braking area is obtained without reducing the extent of the displacement of the working piston.

According to a further development of the invention the braking mechanism has a U-shaped member, which can be fixed to the force reducer of the working piston, particularly by screwing. The force reducer of the working piston, as the name suggests, is used for reducing the piston movement. The possibility of fixing, e.g. screwing the brake mechanism with the aid of the U-shaped member to the force reducer makes it possible to subsequently fit the brake mechanism to existing installations. No additional measure is required, except for the fitting of a pressure hose.

According to the invention the U-shaped member has roughly the same axial length as the working piston and the brake piston.

In order to make the construction of the brake mechanism as simple as possible, the U-shaped member has a flat recess forming the brake cylinder for the brake piston.

The piston surface can advantageously have an elongated shape with parallel sides and semicircular rounded ends. This makes it possible to produce the brake piston from an extruded profile, which only has to be cut to the corresponding length and has to be milled in order to produce the semicircular ends. However, the parallel lateral edges require subsequent treatment.

In order to seal the brake piston in the recess, according to the invention the piston is provided in its circumferential surface with an all-round groove for receiving an O-ring as the seal. In cross-section, the U-shaped member e.g. advantageously extends over roughly half the circumference of the working cylinder.

According to the invention the brake mechanism acts on a point diametrically opposite to the elongated slot of the working cylinder, so that on braking the force reducer remains free from transverse forces, which could cause problems.

This possibility of the application or engagement of the brake element is particularly advantageous if the cylinder casing is cross-sectionally rectangular and there remains little space on the top on either side of the elongated slot. As the U-shaped member extends roughly over half the circumference, the remaining half circumference remains free, so that it is possible to provide here positioning switches or scales, which may be necessary for piston positioning.

However, it is also possible, more particularly if the cylinder casing has a circular cross-sectional shape, for the cylinder to have two preferably identically constructed brake mechanisms arranged symmetrically to a plane passing through the elongated slot. The two brake mechanisms then act on a different side of the casing in each case, so that no transverse forces act on the force reducer during braking. In particular the action directions of the two brake mechanism can form an angle of less that 180° with respect to one another.

BRIEF DESCRIPTION OF THE DRAWINGS

Further features, details and advantages of the invention can be gathered from the claims, the following description of preferred embodiments and the drawings, wherein:

DETAILED DESCRIPTION OF THE PREFERED EMBODIMENTS

Figure 1:
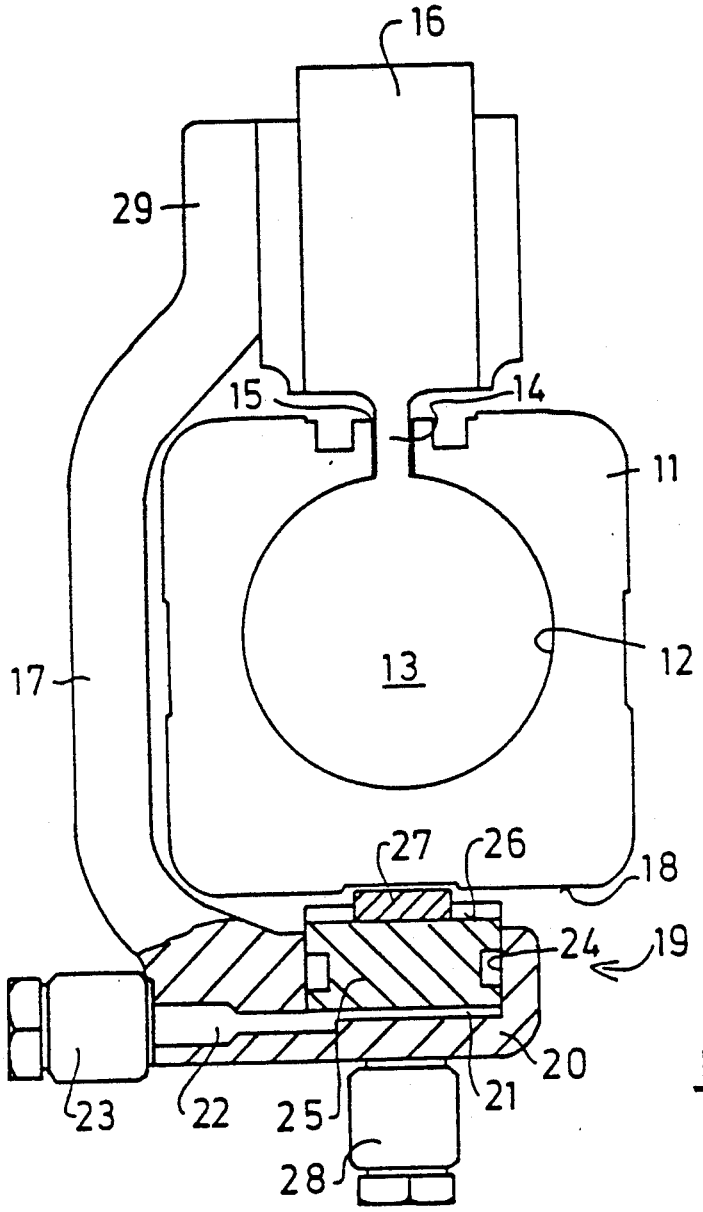
FIG. 1 shows a cross-section through a working cylinder with a roughly square cross-section.

FIG. 1 shows the pressure or pressure medium cylinder 11 in cross-section. It contains a circular bore 12 extending in the longitudinal direction of the pressure cylinder 11 and in which is longitudinally displaceably guided a piston 13. The piston is sealed with respect to the wall of bore 12 by two seals arranged in the vicinity of its longitudinal ends and which are not shown in order to simplify the drawing. The lateral projection 14 of piston 13 passes through a longitudinally directed elongated slot 15. The lateral projection 14 is connected to the force transfer element 16 outside the pressure cylinder 11. In the longitudinal direction of the pressure cylinder 11, force transfer element 16 has roughly the same length as piston 13. The force transfer element 16 has holes to which is fixed the element to be moved with the aid of the piston. Both from the outside of the cylinder and from its inside, the elongaged slot 15 is sealed by a strip-like seal, which is not shown in FIG. 1 in order not to overburden the latter.

To the force transfer element 16 is screwed a roughly L-shaped member 17. Member 17 also has an axial length, which corresponds roughly to the axial length of piston 13. It is shaped in such a way that it corresponds approximately to the external shape of the pressure cylinder 11 and extends over approximately half the circumference of the latter. The lower free leg of member 17 in FIG. 1 consequently passes approximately parallel to the corresponding outside 18 of pressure cylinder 11.

In the vicinity of said leg, the member 17 has a brake mechanism 19, which serves to act roughly centrally on the outside 18 of pressure cylinder 11. This action point is positioned roughly diametrically opposite elongated slot 15.

The member 17 has a recess 21 in its somewhat thicker leg 20 facing the elongated slot 15. Recess 21 is connected by means of a stepped bore 22 to a connecting nipple 23 for the connection of a not shown pressure hose. By means of said pressure hose it is consequently possible to introduce compressed air or hydraulic fluid into the recess 21.

Recess 21 has a cylindrical construction, so that its sidewalls 24 are parallel to one another. A brake piston 25 is inserted in recess 21 and is displaced in the latter as a function of the pressure of the fluid. In FIG. 1, the movement direction of brake piston 25 is from bottom to top or vice versa, said movement direction being approximately radial with respect to the pressure cylinder 11. On the side 26 facing the outside 18 of pressure cylinder 11 is fitted a brake lining 27, e.g. by bonding. In the section according to FIG. 1, it is positioned centrally to the outside 26 of brake piston 25 and therefore also centrally to the outside 18 of pressure cylinder 11.

In order to brake or slow down the piston 13 pressure is forced into the recess 21, so that the brake piston 25 moves radially towards the pressure cylinder 11 and the brake lining 27 presses against the outside 18 of pressure cylinder 11. As a result a braking force is obtained. As this braking force is directed radially and therefore precisely centrally through the projection 14, no transverse forces occur on the force transfer element 16 or the projection 14. Thus, the braking force presses the piston 13 downwards and there is a transverse force-free braking force.

As a function of the circumstances the pressure hose can also be connected to the second connecting nipple 28 shown in FIG. 1.

Figure 2:
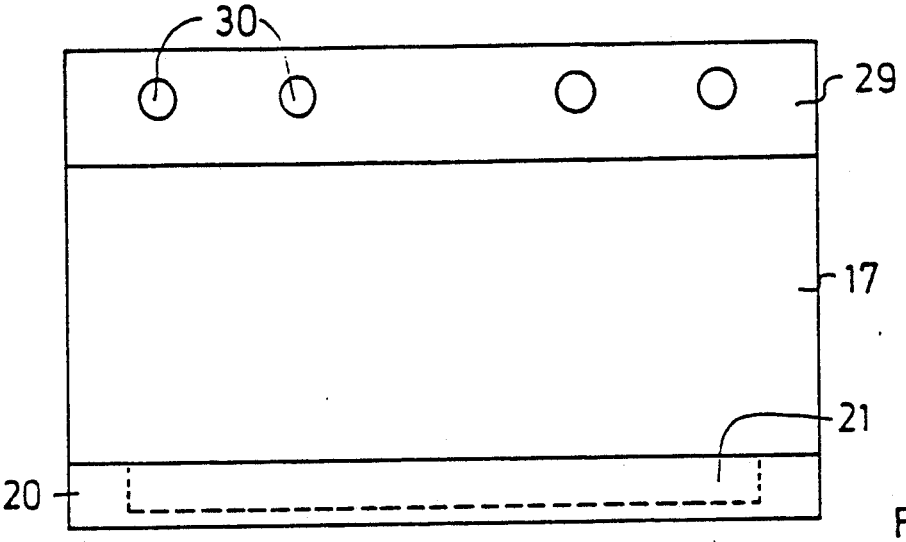
FIG. 2 shows a view of the U-shaped member of the brake mechanism of FIG. 1 from the right.

FIG. 2 shows a side view of the brake member 17 of FIG. 1. In the vicinity of its upper end 29 the brake member is provided with a row of fixing holes, whose arrangement and size correspond to the fixing holes of the force transfer element 16. As a result the member can be subsequently fitted to existing pressure cylinders, which makes it possible to re-equip existing pressure cylinder installations.

FIG. 2 also reveals the considerable axial length of the brake member 17, which leads to a stable brake mechanism and ensures that no torques about its transverse axis are transferred to the piston 13.

Figure 3:
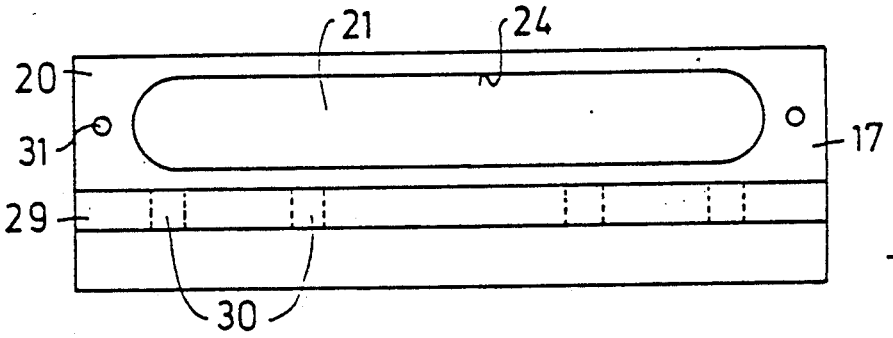
FIG. 3 shows a plan view of the brake member of FIG. 1 viewed from above.

FIG. 3 is a view of the brake member 17 of FIG. 1 from above. It can be seen that, below its upper end 29, the brake member 17 initially passes outwards and then inwards again, so that the lower leg 20 is visible from above. The cylindrical recess 21 forming the cylinder for the brake piston 25 is arranged in said lower leg. This recess 21 has an elongated shape with parallel sidewalls 24. The ends are rounded in semicircular manner. In the vicinity of the ends a taphole 31 is in each case positioned alongside the recess and its significance will be explained hereinafter.

Figure 4:
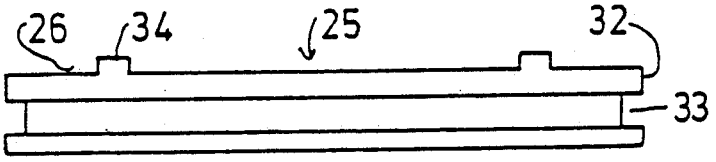
FIG. 4 shows a longitudinal side view of the brake piston.
Figure 5:
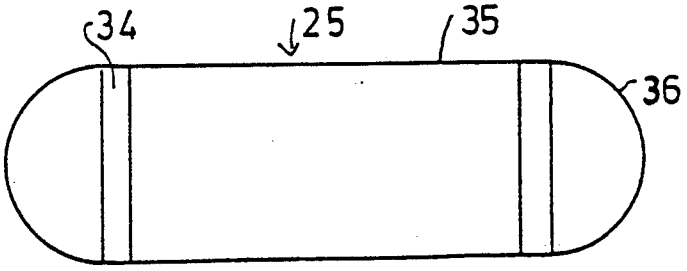
FIG. 5 shows a plan view of the brake piston of FIG. 4 from above.

FIG. 1 diagrammatically shows a longitudinal side view of the brake piston 25 which, in plan view, is shaped like a flat, oval disk, of FIG. 5. In its circumferential surface 32 visible in FIG. 4 it has an all-round, rectangular groove 33, in which is inserted an O-ring for sealing purposes, but which is not shown in order to simplify the drawing.

On its outside 26 intended to engage on the outside 18 of the pressure cylinder 11 the brake piston 25 has two ribs 34, of FIG. 4, between which is inserted and bonded the brake lining 27 visible in FIG. 1. However, the ribs 34 are only intended as an assembly aid and are not required for operational purposes.

FIG. 5 is a plan view of the brake piston 25. It can be seen that the brake piston 25 has two parallel, longitudinally directed lateral edges 35, which are interconnected in the vicinity of the ends by semicircular bows 36. The brake piston shown in FIGS. 4 and 5 can be produced from extruded strand material, e.g. aluminium, provided that no significance is attached to the ribs 34. This profile already contains the groove 33. The brake piston is produced in that the profile is cut to the correct length and the semicircular bow 36 is milled with the groove 33 therein.

Figure 6:
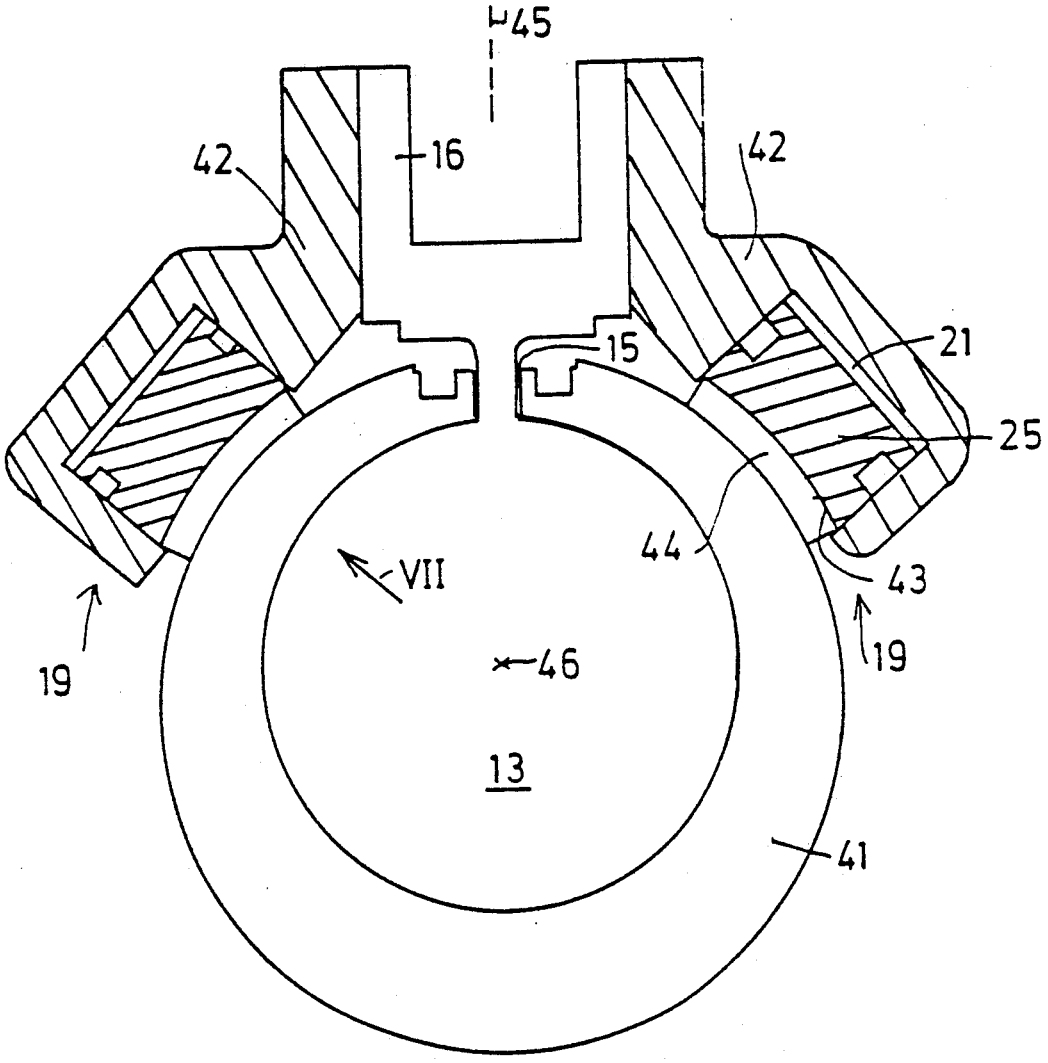
FIG. 6 shows a cross-section corresponding to FIG. 1 of a second embodiment.

FIG. 6 shows a section of a second embodiment corresponding to FIG. 1, in which the pressure cylinder 41 has an externally circular cross-section. In this cross-sectional form of the pressure cylinder, it would obviously also be possible to use the brake mechanism of the embodiment according to FIG. 1. This would also lead to transverse force-free braking. However, as in the case of the embodiment according to FIG. 6 sufficient space is available on either side of elongated slot 15, the embodiment of FIG. 6 has two U-shaped members 42 with in each case one brake mechanism 19. Although the members 42 have a different cross-sectional shape to the member 17 of the embodiment of FIG. 1, they are otherwise constructed in the same way, i.e. they extend over the axial length of piston 13 and have recesses 21 for receiving the brake piston 25. The brake piston 25 has substantially the same shape as in the embodiment according to FIGS. 1 to 5, with the single difference that the outer face 43 of the brake piston 25 facing the outside of pressure cylinder 11 has a circular cylindrical construction and is in fact concentric to the shape of the pressure cylinder 41. Here again brake linings 44 are bonded on and their shape corresponds to the external shape of the pressure cylinder 41. Both the members 42 are identical, but are arranged symmetrically to a plane indicated by the broken line 45 and which passes through the longitudinal axis 46 of piston 13 and centrally through the elongated slot 15. The force occurring on braking consequently occurs in the angle bisector located in plane 45, so that this arrangement is also free from transverse forces.

Figure 7:
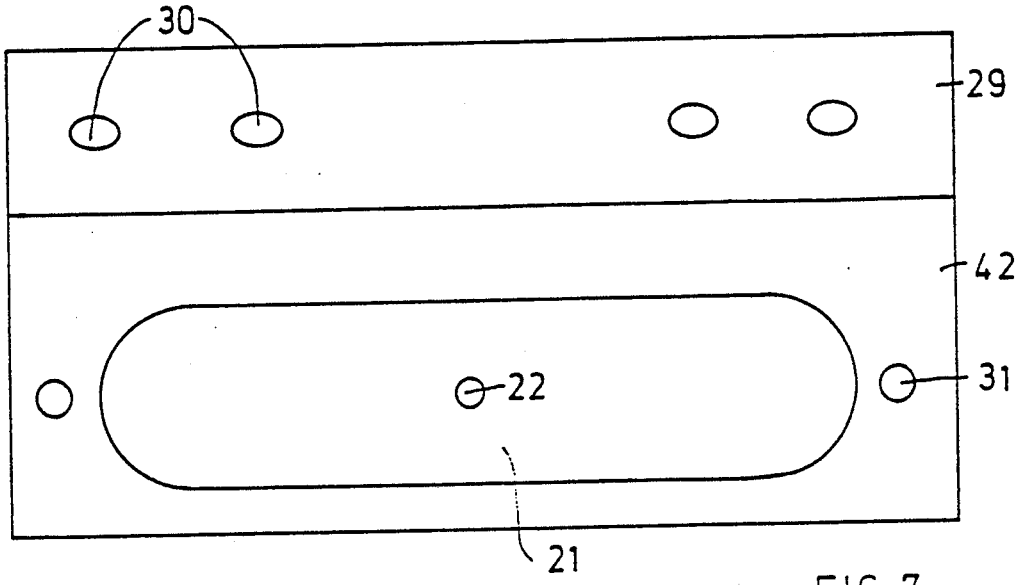
FIG. 7 shows a view of the brake member of FIG. 6 in the direction of arrow 7 therein.

FIG. 7 is a view of bow 42 in the direction of arrow VII in FIG. 6. The shape of recess 21 completely corresponds to that in the embodiment according to FIG. 3. The members 42 of the embodiment according to FIG. 6 can also be subsequently fitted to an existing force transfer element 16.

Figure 8:
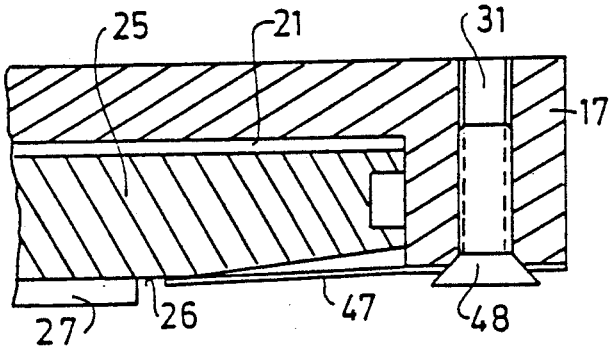
FIG. 8 shows a larger-scale section through a brake mechanism.

FIG. 8 shows on a larger scale a section through a longitudinal end of a member 17 or 42, in order to show the function of the tapholes 31. A tongue spring 47 engages on the outside 26 of piston 25 and is fixed to member 17 with the aid of a screw 48. Such a tongue spring 47 is fixed to both longitudinal ends of each piston 25 and serves to force the brake piston 25 back into its starting position when the pressure drops in recess 21. In said starting position the brake lining 27 does not engage on pressure cylinder 11 or 41. Thus, the brake is released when there is no pressure.

I claim:

1. A pressure cylinder comprising:

a terminally closed tubular casing having a sealed elongated slot, the tubular casing having an outer surface;

a sealed piston longitudinally displaceably guided in an interior of said casing;

a force transfer element extending from said piston through the elongated slot;

at least one brake mechanism fixed to the force transfer element, said brake mechanism providing a recess defining a brake cylinder;

a brake piston disposed in said recess and movable by fluid pressure, the brake piston being movable in a direction substantially radial to the casing and having a lining surface facing the outer surface of the casing; and a brake lining attached to said lining surface and having a brake area for removably contacting the outer surface of the casing.

2. The pressure cylinder according to claim 1 in which the brake area corresponds in contour to the contour of the outer surface of the casing.

3. The pressure cylinder according to claim 1 in which the lining surface is substantially equal in length to an axial length of the sealed piston.

4. The pressure cylinder according to claim 1 in which the brake mechanism has a substantially U-shaped member attached to the force transfer element by screws.

5. The pressure cylinder according to claim 4 in which the U-shaped member has substantially the same axial length as the sealed piston.

6. The pressure cylinder according to claim 1 in which the lining surface of the brake piston has an elongated shape with two parallel sides and semicircular ends.

7. The pressure cylinder according to claim 1 in which the brake piston has a peripheral surface facing an interior surface of the braking cylinder and provided with a peripheral groove.

8. The pressure cylinder according to claim 4 in which the member surrounds substantially half the circumference of the outer surface of the casing.

9. The pressure cylinder according to claim 1 in which the brake area removably contacts a portion of the outer surface of the casing, said portion positioned opposite to the elongated slot.

10. The pressure cylinder according to claim 1 comprising two of said at least one brake mechanism fixed to the force transfer element symmetrically relative to the elongated slot, each brake mechanism having a direction of action perpendicular to said brake area.

11. The pressure cylinder according to claim 10 in which the directions of actions of the two braking mechanisms form an angle of less than 180 degrees.

* * * * *